US006206735B1

(12) United States Patent
Zanolli

(10) Patent No.: US 6,206,735 B1
(45) Date of Patent: Mar. 27, 2001

(54) PRESS FIT PRINT CIRCUIT BOARD CONNECTOR

(75) Inventor: James R. Zanolli, North Smithfield, RI (US)

(73) Assignee: Teka Interconnection Systems, Inc., Warwick, RI (US)

( * ) Notice: Subject to any disclaimer, the term of this patent is extended or adjusted under 35 U.S.C. 154(b) by 0 days.

(21) Appl. No.: 09/143,175

(22) Filed: Aug. 28, 1998

(51) Int. Cl.[7] ..... H01R 13/405
(52) U.S. Cl. ..... 439/736; 439/404; 439/751
(58) Field of Search ..... 439/751, 736, 439/404, 405

(56) References Cited

U.S. PATENT DOCUMENTS

| | | | | |
|---|---|---|---|---|
| 3,862,791 | * | 1/1975 | Miller | 339/198 |
| 3,922,477 | * | 11/1975 | Glowacz | 174/18 |
| 4,012,102 | * | 3/1977 | Cherney et al. | 339/97 |
| 4,384,757 | * | 5/1983 | Andrews, Jr. et al. | 339/258 |
| 4,575,176 | * | 3/1986 | Castello et al. | 339/195 |
| 4,579,404 | * | 4/1986 | Lockard | 339/14 |
| 5,108,317 | * | 4/1992 | Beinhaur et al. | 439/736 |
| 5,139,446 | * | 8/1992 | Costello et al. | 439/751 |
| 5,224,879 | * | 7/1993 | Mullins et al. | 439/651 |
| 5,411,418 | * | 5/1995 | Welsh et al. | 439/751 |
| 5,433,628 | * | 7/1995 | Sadaishi et al. | 439/736 |
| 5,595,513 | * | 1/1997 | Kondo | 439/862 |
| 5,823,830 | * | 10/1998 | Wurster | 439/751 |

* cited by examiner

*Primary Examiner*—Paula Bradley
*Assistant Examiner*—Truc Nguyen
(74) *Attorney, Agent, or Firm*—Lackenbach Siegel Marzullo Aronson & Greenspan, P.C.

(57) ABSTRACT

A press fit contact for through hole mounting has a longitudinal axis and a contact portion along the axis for mounting with an associated electrical component to make electrical contact therewith. A leg portion is configured and dimensioned to be inserted through a mounting plated through hole of a support member. The leg portion includes an interference element along at least a portion thereof dimensioned to be receivable within the plated through hole to establish a press-fit or interference-fit and mechanical and electrical contact with the plating on the mounting hole. An intermediate portion is provided between and integrally formed with the contact and leg portions, the portions all being generally aligned along the longitudinal axis. A pressure-bearing, in each instance element, in the form of one or more holes and with or without associated blade tabs, is formed on the intermediate portion within the perimeter or inside the lateral edges defined by the intermediate portion. A pressure member element in the form of a molded plastic member is arranged on the intermediate portion to encapsulate the pressure-bearing, in each instance element or elements to transmit forces applied thereto acting along the longitudinal axis in the direction from the contact portion towards the leg portion. In this manner, insertion forces applied to the pressure-applying member are transmitting to the intermediate and leg portions for facilitating insertion of the leg portion through the plated through hole by coupling the forces to the pressure bearing elements or elements.

22 Claims, 2 Drawing Sheets

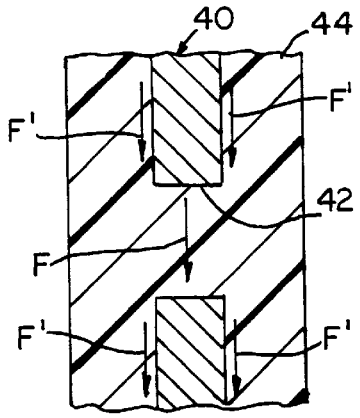
FIG. 4
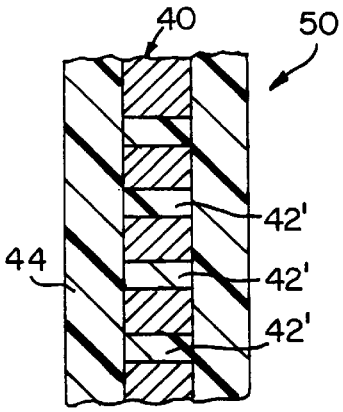
FIG. 5
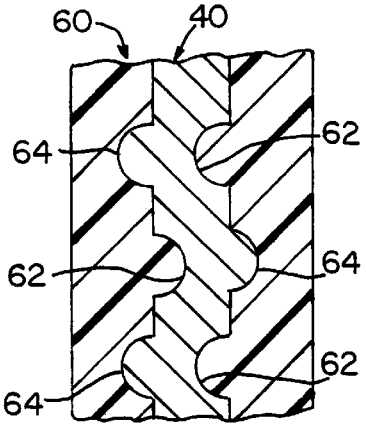
FIG. 6
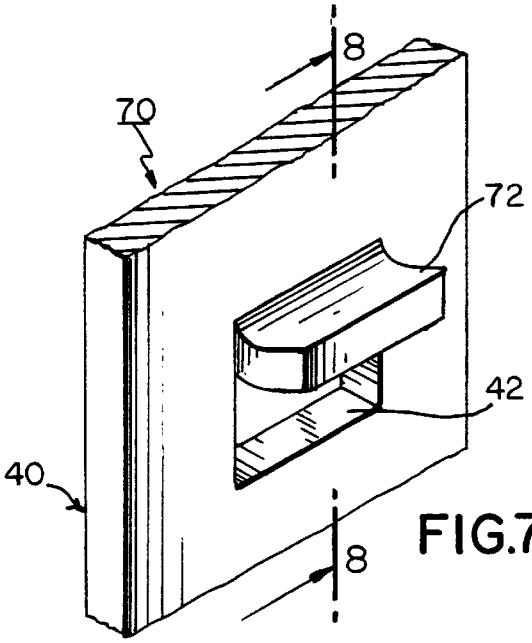
FIG. 7
FIG. 8
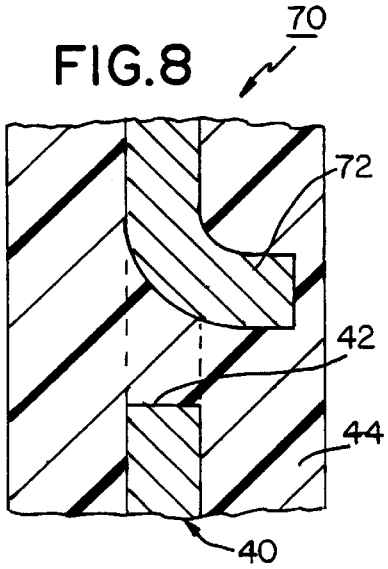
FIG. 9
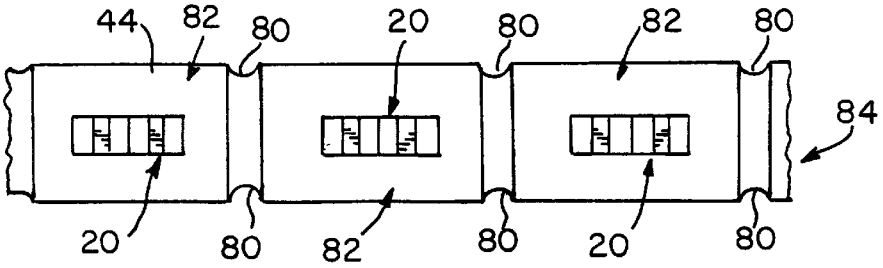

PRESS FIT PRINT CIRCUIT BOARD CONNECTOR

BACKGROUND OF THE INVENTION

1. Field of the Invention

The present invention generally relates electrical connectors and, more particularly, to press fit contacts for through-the-hole mounting and a strip of contacts formed of same.

2. Description of the Prior Art

Press fitting of contacts through plated through holes in a printed circuit board (PCB) to provide an electrical connection without solder has been common and basic to the industry since the 1970s. Typically, an electrical contact is provided with a leg or post which is designed to be received within a plated through hole in press or interference fit therewith. This may be achieved by selecting the dimensions of the leg or post somewhat larger than the plated through hole diameter to provide the interference fit by deforming the coating and/or substrate of the plated through hole. Alternatively, the leg or post may be provided along at least one portion thereof with a compliant or flexible region which is compressible when forced into a smaller dimensioned through hole.

Referring to FIG. 1, a press fit contact or terminal 10 in accordance with the prior art is illustrated, following the teachings of U.S. Pat. Nos. 4,156,553; 4,188,715; 4,220,393; and 4,045,868, all issued to Ammon et al. and assigned to Elfab Corporation of Dallas, Tex. Referring to FIG. 1, the prior art terminal 10 is provided with a contact portion 10', a leg or post portion 10" and load bearing shoulders 12, formed between the contact and leg portions, which project laterally in opposite directions as shown. The means for transmitting the force to the load-bearing-, in each instance shoulders is an external tool (not shown) which imparts forces F directly on the terminal's load-bearing-, in each instance shoulders 12, such as an insulator housing with contact cavities containing corresponding load-bearing-, in each instance shoulders by which the forces are transmitted from the shoulders of the housing contact cavity to the corresponding load-bearing-, in each instance shoulders on the electrical terminal 10. The drawbacks of this aforementioned prior art contact include the fact that the load-bearing-, in each instance shoulders 12 formed on the electrical contact or terminal require the contact to include significant projections or protuberances which project laterally of the main body portion of the contact so that the contact becomes wider than would normally be required in a non-press fit design. These load-bearing-, in each instance shoulders 12 also necessarily have sharp corners and edges as a result of the cutting and forming operations in the stamping process. Minimal distances between electrical contacts and sharp corners typically generate undesirable cross-talk in today's high speed electronic systems.

SUMMARY OF THE INVENTION

It is, accordingly, an object of the present invention to provide a press fit contact for through hole mounting which does not have the disadvantages of comparable existing contacts.

It is another object of the present invention to provide a press fit contact which is simple in construction and economical to manufacture.

It is still another object of the present invention to provide a press fit contact for through-hole mounting which can be mounted individually or a plurality of such contacts may be simultaneously mounted in banks or strips.

It is yet another object of the present invention to provide a press fit contact of the type above suggested which does not materially alter the exterior dimensions and/or the inter-contact minimum spacing.

It is still a further object of the present invention to provide a press fit contact as in the previous objects which minimizes undesirable cross talk in high speed electronic systems.

It is yet another object of the present invention to provide a press fit contact for through hole mounting which provides a suitable load bearing mechanism while reducing the amount of metal required as compared to prior or existing contacts.

It is an additional object of the present invention to provide a press-fit contact of the type under discussion which can be manufactured in strip form as a continuous series of contacts and arranged for use as one or a plurality of contacts that can be separated from the continuous strip.

It is still an additional object of the present invention to provide a press fit contact for through hole mounting that can be readily used both in the assembly of connectors as well as for direct mounting on a substrate or printed circuit board (PCB).

It is yet an additional object to provide a method of making press-fit terminals or contacts as in the previous objects individually and in continuous strips.

In order to achieve the above objects, as well as others which will be become evident hereafter, a press fit terminal or contact for through-the-hole mounting and having a longitudinal axis comprises a contact portion along said axis for mating with an associated electrical component to make electrical contact therewith. A leg portion is provided which is configured and dimensioned to be inserted through a mounting plated through hole of a support member, such as a printed circuit board. Said leg portion includes interference means along at least a portion thereof dimensioned to be receivable within said plated through hole to establish a press or interference fit providing both mechanical and electrical contact with the plating on said mounting hole. An intermediate portion is provided between and integrally formed with said contact and leg portions. Said portions are all generally aligned along said longitudinal axis and said intermediate portion having lateral edges which generally define a width normal to said longitudinal axis which is no greater than the width of said contact portion. Pressure-bearing means is provided on said intermediate portion between said lateral edges. Pressure applying means is provided arranged on said intermediate portion to transmit forces applied thereto and acting along said longitudinal axis in the direction from said contact portion toward said leg portion. In this manner, insertion forces applied to said pressure-appling-, in each instance means are transmitted to said intermediate and leg portions for facilitating insertion of same leg portion through the plated through hole by coupling said forces to said pressure-bearing-, in each instance means.

In accordance with a presently preferred embodiment, said pressure-appling-, in each instance means comprises a molded member molded about said intermediate portion for encapsulating and making contact with said pressure bearing, which is in the form of a hole between said lateral edges of said intermediate portion. Said molded member extends through said hole in order to encapsulate it and make contact therewith.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 4 is a partial cross sectional view of one of the contacts in FIG. 3, taken along line 4—4, to illustrate the manner in which the molded plastic member encapsulates the intermediate portion and extends through the hole formed within the body of the intermediate portion to enhance or increase the ability to transmit or couple forces applied to the molded member to the encapsulated contact to facilitate insertion of the leg of the contact into a plated through hole;

FIG. 5 is a side elevational view, in cross section, of a fragmented portion of a pin in accordance with the present invention, illustrating an alternate embodiment in which a plurality of holes are provided through which the encapsulating plastic member can extend through;

FIG. 6 is a side elevational view of an intermediate section of a press fit contact in accordance with a further embodiment of the invention, illustrating the use of indentations and recesses that interact with the molded member to transmit forces to the terminal or contact;

FIG. 7 is a perspective view of still a further embodiment in which a combination of an opening and a splayed tab serve as the pressure-bearing-, in each instance element;

FIG. 8 is a cross sectional view of the terminal shown in FIG. 7, taken along 8—8; and FIG. 9 is a top elevational view of a contact of the type shown in FIG. 3, illustrating notches or grooves that may be formed in the encapsulating molded member for facilitating severance of one or more of the terminals or contacts from the rest of the strip.

DESCRIPTION OF THE PREFERRED EMBODIMENTS

Figure 2:
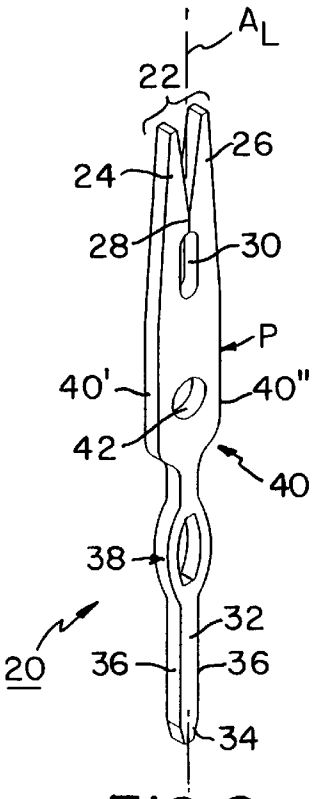
FIG. 2 is similar to FIG. 1, but illustrates, in perspective, a single press fit terminal or contact in accordance with the present invention.

Referring now specifically to the Figures, in which identical or similar parts are designated by the same reference numeral throughout, and first referring to FIG. 2, a press fit terminal or contact in accordance with the present invention for through-hole mounting is generally designated by reference numeral 20.

The contact or terminal 20 generally defines a longitudinal axis $A_L$ and defines an upper contact portion 22, as viewed in FIG. 2. The specific configuration of the contact portion 22 is not critical, although it is typically configured and dimensioned for mating with an associate electrical component in order to make electrical contact therewith. In the embodiment shown in FIG. 2, the contact portion 22 includes two upwardly tapered resilient fingers 24, 26, the two fingers tapering inwardly as shown and ultimately coming into contact with each other at 28, below which there is provided an opening or recess 30 for resiliently receiving a conductive member. The inwardly tapered fingers 24, 26 serve as a lead-in for an appropriate contact on an associated connector. As indicated, the specific configuration of the contact portion 22 is not critical, and any prior art or known contact portion may be used in connection with the press fit contact 20.

Figure 3:
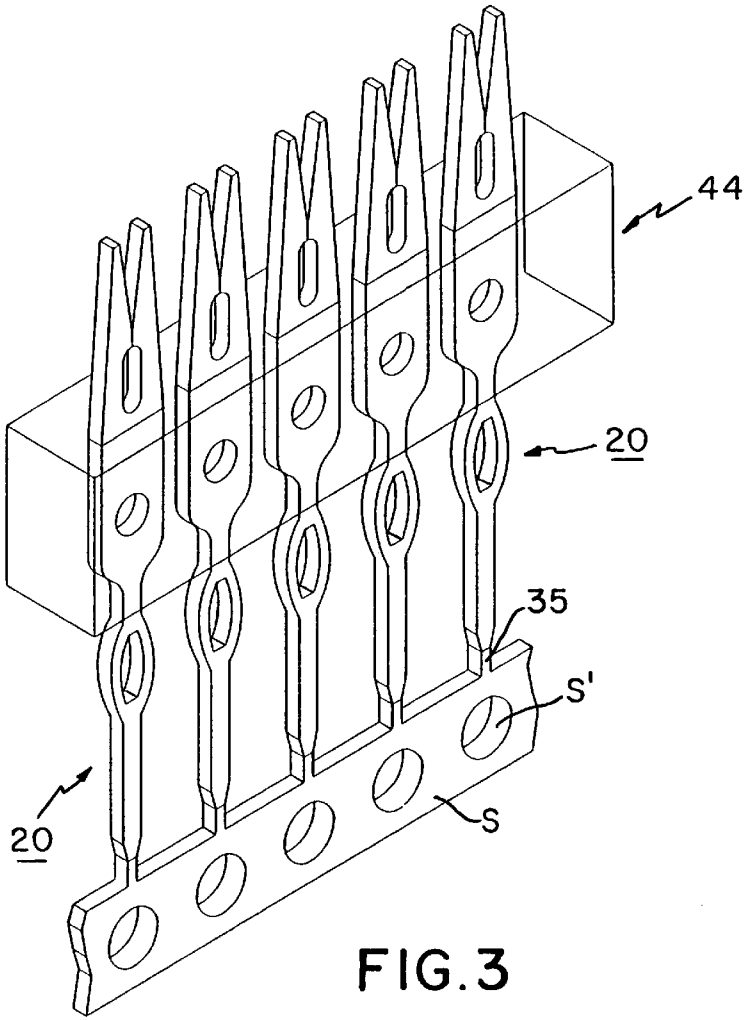
FIG. 3 is a perspective view of a plurality of press fit terminals or contacts in accordance with the present invention, similar to the contact shown in FIG. 2, showing each of the contacts attached to a continuous carrier strip and intermediate portions of the contacts, between the upper contact portions and the lower leg portions or posts, encapsulated by a molded plastic member.

At the lower end, as viewed in FIG. 2, there is provided a leg portion 32 which is configured and dimensioned to be inserted through a mounting plated through hole on a support member (not shown), such as a printed circuit board (PCB). For this purpose, the free end of the leg portion 32 is preferably provided with a taper 34, as shown. As shown in FIG. 3, the tapered ends 34 of the leg portions may be attached, by means of connecting tabs 35, to a carrier strip S provided with indexing holes S' for feeding the strip through insertion machinery, in a manner well known to those skilled in the art.

The leg portion 32 includes interference means along at least a portion thereof dimensioned to be receivable within a plated through hole to establish a press fit or interference fit and mechanical and electrical contact with the plating on the mounting hole. As will be evident to those skilled in the art, the leg portion 32 may simply be slightly oversized, but otherwise rigid, and be received within a slightly undersized plated through hole. The leg portion or post 32 may provide such interference fit, particularly if the leg portion is provided with somewhat sharp edges, such as at 36, which can displace some of the coating or conductive layer within the plated through hole. In the embodiment shown in FIG. 2, however, the interference means is in the form of a compliant member 38 as shown, which is compressible in radial directions in relationship to the longitudinal axis $A_L$ in order to be receivable within the mounting through hole in a compressed state. The specific form or nature of the compliant member 38 is likewise not critical, and any prior art compliant member can be used in connection with the present invention. An intermediate portion 40 is provided between and integrally formed with the contact portion 22 and the leg portion or post 32, all of the portions 22, 32 and 38 being generally aligned along the longitudinal axis $A_L$. The intermediate portion 38 defines a predetermined perimeter P defined by the lateral edges 36. A hole 42 is provided on the intermediate portion 40 within the predetermined perimeter P or inside the lateral edges 40', 40".

Figure 1:
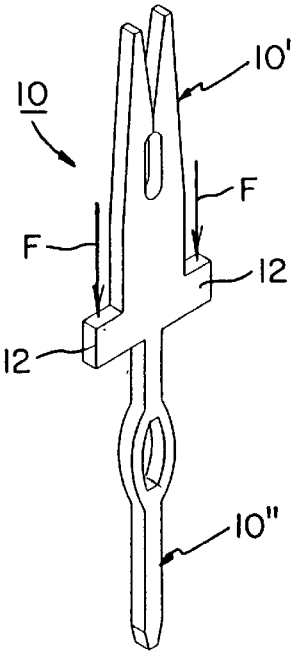
FIG. 1 PRIOR ART
FIG. 1 is a perspective view of a prior art press fit contact illustrating the laterally extending load-bearing shoulders on which forces may be applied to force the compliant portion on the leg or post of the contact to be received within a plated through hole to create an interference fit and electrical contact therewith.

A pressure-appling-, in each instance member 44 is provided on the intermediate portion 40 to transmit forces applied to the pressure-bearing-, in each instance member and acting along the longitudinal access $A_L$ in the direction of the contact portion 22 toward the leg portion or post 32. In this manner, insertion forces F applied to the pressure-appling-, in each instance member 44 are transmitted to the intermediate portion 40 for facilitating the insertion of the leg portion 32 through a plated through hole by coupling the forces to the pressure-bearing-, in each instance member. In the embodiment illustrated in FIGS. 2 and 3, the pressure-bearing-, in each instance element is in the form of a hole 42, generally centrally positioned between the two lateral edges 40', 40" of the intermediate portion 40, forming part of the edge perimeter of the contact. An important feature of the present invention is that the hole 42 or other pressure-bearing-, in each instance members, to be described, are positioned between the lateral edges 36 of the contact to avoid lateral projections, such as the shoulders 12 of the prior art terminal shown in FIG. 1. In this manner, the intercontact minimum spacing is maximized and electrical interference and cross talk is minimized between adjacent connectors.

Where the pressure-applying-, in each instance element is a hole 42, as shown, the pressure-applying member arranged on the intermediate portion 40 may be in the form of a molded member 44 which may be applied to the contacts by an insert molding process in which the plastic fills in the hole 42, or other perforations to be described, as best shown in FIG. 4. When the molded material fills in the hole 42 and surrounds the intermediate portion 40, as shown in FIG. 4, the molded member 44 can apply a primary force F inside the hole capable of transmitting a force applied thereto to the electrical terminal or contact. This primary force F is supplemented by secondary forces F' which are in the nature of frictional forces transmitted by the molded member 44 to the sides of the walls of the intermediate portion 40, as suggested in FIG. 4. It will be clear, therefore, that the application of the force F, with the invention, has been shifted from points outside or beyond of the predetermined shape or lateral edges 36 of the contact, as in FIG. 1, to points between the lateral edges of the intermediate portion. The design, therefore, achieves the objective of transmitting insertion forces to the contacts without relying on lateral extensions or projections, such as the load-bearing shoulders 12 shown in FIG. 1. By eliminating these lateral protuberances, the intercontact spacing is maximized and electrical interference between adjacent contacts is minimized.

Referring to FIG. 5, an alternate embodiment 50 of the press fit contact is illustrated in which the intermediate portion 40 is provided with a plurality of openings, in the form of circular apertures or holes 42'. The maximum insertion force that can be applied prior to failure by the interface between the molding member and the intermediate portion is primarily a function of the total cross sectional area of the molding material extending through the hole(s) or aperture(s). The number of apertures provided and their sizes can readily be determined for a given or desired failure mode. It is clear that the same failure point can be achieved when the cross sectional area of a single opening is substantially equal to the total cross sectional areas of the plurality of holes 42'. It should also be clear that the specific shape(s) or configuration(s) of the opening(s) is not critical and these may be circular, rectangular, square, etc.

In FIG. 6, a further embodiment 60 of the invention is illustrated in which combinations of recesses 62 and protuberances 64 are formed on both sides of the intermediate portion 40. When the molding material sets within the recesses and about the protuberances, interference fits are created, which can also be used to transmit insertion forces or pressures to the leg portions of the contact(s). In this connection, it should be clear that it is also possible to use only recesses or only projections or protuberances or a combination thereof, as shown in FIG. 6. Furthermore, such recesses or protuberances can also be used in combination with through holes or openings of the type illustrated in FIGS. 2–5.

Referring to FIGS. 7 and 8, a further embodiment 70 of the invention is illustrated in which the pressure-bearing-, in each instance member includes both an opening 42 and a tab 72 which projects outwardly from the surface of the intermediate portion 40. Therefore, instead of die cutting the material of the intermediate portion completely to form a complete hole or opening, the material is partially die cut, such as about three sides of a square or rectangle, so that the die cut section can remain attached to the intermediate portion and be splayed or bent out of the plane of the intermediate portion to form a tab or a protuberance 72. With this arrangement, the molded material not only enters into the resulting hole or opening 42 but also surrounds and encapsulates the tab 72, increasing the force that can be applied to the pressure-bearing-, in each instance surfaces and significantly increasing the force at which failure may result. Although a single tab is shown in FIG. 7, it will be clear that multiple tabs may be formed for each of the openings of the type, for example, shown in FIG. 5.

FIG. 9 also illustrates the use of notches or grooves 80 generally parallel to the longitudinal axes of the contact pins and positioned substantially midway between adjacent or successive insert terminals or contacts 20, the notches or grooves being dimensioned and configured to facilitate the breaking away of one or more modules 82 from a continuous strip 84, each module consisting of a contact and an associated section of molded material about the intermediate portion of the contact. However, other arrangements may be used to separate a desired or predetermined number of contacts from the strip, including severing the molded member by means of any suitable cutting apparatus, such as a saw.

It will be evident from the described examples that the present invention increases the distance between contacts and eliminate sharp corners, as compared to the prior art design. The proposed design facilitates the use of of certain high speed printed circuit board assemblies as well as offering improved manufacturing efficiencies in assembling the press fit connectors to printed circuit boards. Manufacturing efficiency improvements result as the insert molding process allows the finished connector assemblies to be manufactured in a continuous strip form that can be packaged on reels. Continuous packaging on reels allows for simple, low cost, high speed (throughput) automation capable of separating the continuous connector assembly into separate strips with the desired number (s) of electrical contacts and simultaneously press fitting the assembly into a printed circuit board.

While this invention has been described in detail with particular reference to a preferred embodiment thereof, it will be understood that variations and modifications will be effected within the spirit and scope of the invention as described herein and as defined in the appended claims.

What is claimed is:

1. A press fit printed circuit board connector for through-hole mounting, comprising a plurality of inline contact spaced from each other within a substantially common plane, each contact having a longitudinal axis and a contact portion along said axis for mating with an associated electrical component to make electrical contact therewith; a leg portion configurated and dimensioned to be inserted through a plated-through-hole of the printed circuit board, said leg portion including interference means along at least a portion thereof dimensioned to be receivable within said plated-through-hole to establish a press-fit or interference-fit and mechanical and electrical contact with the plating in an associated hole; and an intermediate portion between and integrally formed with said contact and leg portions, said portions of each contact all being generally aligned along an associated longitudinal axis, said intermediate portion having lateral edges that are substantially free of transverse loadbearing protuberances; pressure-bearing-, in each instance means forms a pressure bearing recess provided between the lateral edges of each intermediate portion; and an elongate member extending along said common plane over molding each of said intermediate portions so that molding material flows through and fills entire area of said pressure bearing means and fixedly securing each of said pressure-bearing-, in each instance means, to insure that insertion forces applied to said elongate member are transmitted to said intermediate and leg portions so that molding material flows and fills entire said pressure bearing recess for facilitating insertion of said leg portions through the plated-through-holes by coupling said forces to said pressure-bearing-, in each instance means without relative movements between said contacts and said elongate member.

2. A connector as defined in claim 1, wherein said interference means is a compliant member which is compressible in radial directions in relation to said longitudinal axis to be receivable within said mounting through hole in a compressed state.

3. A connector as defined in claim 1, wherein each contact is formed of flat sheet material defining a predetermined plane.

4. A connector as defined in claim 3, wherein all said portions of each contact are generally arranged in said predetermined plane.

5. A contact as defined in claim 3, wherein said intermediate portion has lateral edges forming part of a perimeter defined by said portions, said pressure-bearing means being arranged on said intermediate portion between said lateral edges.

6. A connector as defined in claim 1, wherein said elongate member comprises a section of molded material secured to said intermediate portion.

7. A connector as defined in claim 1, wherein each of said pressure-bearing means comprises a bearing hole within said intermediate portion and said elongate member extends through said bearing hole.

8. A connector as defined in claim 1, wherein each of said pressure-bearing means comprises a plurality of bearing holes within said intermediate portion and said molded member extends through said plurality of holes.

9. A connector as defined in claim 1, wherein each of said pressure-bearing means comprises as least an indentation or recess within said intermediate portion and said molded member extends into said indentation or recess.

10. A connector as defined in claim 1, wherein said pressure-bearing mean comprises a member molded about said intermediate portion to encapsulate and make connector with said pressure-bearing means.

11. A connector as defined in claim 10, wherein said pressure-bearing means comprises a bearing hole within said intermediate portion and said molded member extends through said bearing hole.

12. A connector as defined in claim 10, wherein said pressure-bearing means comprises a plurality of bearing holes within said intermediate portion and said molded member extends through said plurality of holes.

13. A connector as defined in claim 10, wherein said pressure-bearing means comprises as least an indentation or recess within said intermediate portion and said molded member extends into said indentation or recess.

14. A connector as defined in claim 1, wherein each of said pressure-bearing means comprises at least one protuberance extending out of said plane and arranged between said lateral edges, said at least one protuberance extending into said elongate member.

15. A connector as defined in claim 14, wherein said at least one protuberance comprises a surface portion of said intermediate portion which is die cut and splayed out of said plane.

16. A connector as defined in claim 15, wherein said splayed surface portion is bent to a position substantially normal to said plane.

17. A connector as defined in claim 15, wherein said splayed surface portion is bent at an angle of less than 90° with the normal to said plane in the direction of said connector portion.

18. Method of forming a press fit printed circuit board connector for through-hole-mounting having a longitudinal axis, comprising the steps of arranging a plurality of inline contact spaced from each other within a substantially common plane, each contact forming a contact portion along said axis for mating with an associated electrical component to make electrical contact therewith; forming a leg portion configurated and dimensioned to be inserted through a mounting plated through hole of a support member, said leg portion including interference means along at least a portion thereof dimensioned to be receivable within said plated through hole to establish a press-fit or interference-fit mechanical and electrical contact with the plating on said mounting hole; and forming an intermediate portion between and integrally formed with said contact and leg portions and being substantially free of transverse loadbearing protuberances, said portions all being generally aligned along said longitudinal axis, said intermediate portion defining a predetermined perimeter; providing pressure-bearing-, in each instance means on said intermediate portion within said predetermined perimeter; and molding an elongate member extending along said common plane for encapsulating each of said intermediate portions, whereby insertion forces applied to said elongate member are transmitted to said intermediate and leg portions for facilitating insertion of said leg portions through the plated-through-hole by coupling said forces to said pressure-bearing-, in each instance means.

19. Method of forming a printed circuit board connector for through-hole mounting according to claim 18, wherein said portions are stamped from a flat sheet of metal.

20. Method of forming a printed circuit board connector for through-hole mounting according to claim 18, wherein said pressure-bearing means is a hole and said pressure-applying means is in the form of a molded member applied to said intermediate portion by an insert molding process.

21. Method of forming a printed circuit board connector for through-hole mounting according to claim 18, wherein a continuous series of terminals or contart are initially formed connected to each other by means of a carrier strip and further comprising the step of removing the carrier strip after said intermediate portions have been encapsulated within the molded elongate member.

22. Method of forming a press fit connector for through-hole mounting according to claim 21, wherein said molded member is a continuous strip substantially parallel to said carrier strip and molded about each of said terminals or contart by means of the molded member.

* * * * *